US008669713B2

(12) United States Patent
Wu

(10) Patent No.: US 8,669,713 B2
(45) Date of Patent: Mar. 11, 2014

(54) METHOD FOR SETTING AND ADJUSTING LIGHT EMITTED FROM AN ADJUSTABLE LIGHTING DEVICE, ADJUSTABLE LIGHTING DEVICE AND LIGHT-ADJUSTING CIRCUIT THEREOF

(75) Inventor: Chih-Yen Wu, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 163 days.

(21) Appl. No.: 13/431,006

(22) Filed: Mar. 27, 2012

(65) Prior Publication Data

US 2013/0015775 A1 Jan. 17, 2013

(30) Foreign Application Priority Data

Jul. 13, 2011 (CN) ..... 2011 1 0204587

(51) Int. Cl.

| | |
|---|---|
| ***H05B 37/00*** | (2006.01) |
| ***H05B 39/00*** | (2006.01) |
| ***H05B 41/14*** | (2006.01) |

(52) U.S. Cl.
USPC ..... 315/201; 315/127; 315/312; 315/313; 315/362

(58) Field of Classification Search
None
See application file for complete search history.

(56) References Cited

U.S. PATENT DOCUMENTS

2004/0085030 A1* 5/2004 Laflamme et al. ..... 315/291
2005/0112801 A1* 5/2005 Russell et al. ..... 438/116

* cited by examiner

*Primary Examiner* — Anh Tran
(74) *Attorney, Agent, or Firm* — Rosenberg, Klein & Lee

(57) ABSTRACT

A method for setting and adjusting light emitted from an adjustable lighting device is disclosed. The adjustable lighting device includes a timing unit and a non-volatile memory (NVM) module for storing a record data which includes a memory flag changeable between a set state and a reset state, and a plurality of light setting values. In the method, the adjustable lighting device is configured to allow a user to select an illumination state of the light, and to change the memory flag in the record data to the set state and to store the record data with a corresponding one of the light setting values when a elapsed time counted by the timing unit is longer than a predetermined threshold time period.

8 Claims, 6 Drawing Sheets

METHOD FOR SETTING AND ADJUSTING LIGHT EMITTED FROM AN ADJUSTABLE LIGHTING DEVICE, ADJUSTABLE LIGHTING DEVICE AND LIGHT-ADJUSTING CIRCUIT THEREOF

CROSS-REFERENCE TO RELATED APPLICATION

This application claims priority of Chinese Application No. 201110204587.4, filed on Jul. 13, 2011.

BACKGROUND OF THE INVENTION

1. Field of the Invention

The invention relates to alighting device, a method for controlling the lighting device and a circuit thereof, more particularly to an adjustable lighting device, a method for setting and adjusting light emitted therefrom, and a light-adjusting circuit thereof.

2. Description of the Related Art

FIG. 1 illustrates a conventional adjustable lighting device 1 including a light emitting diode (LED) module 10 and a light-adjusting circuit 11. The adjustable lighting device 1 can be electrically connected to an alternating current (AC) power source for receiving an AC power therefrom, and is operable to selectively emit light with various illumination states, each of which corresponds to a specific brightness and a specific color temperature.

The LED module 10 is operable to emit the light with various illumination states, and includes a first light emitting unit 101 that is operable to emit light with a warm color, and a second light emitting unit 102 that is operable to emit light with a cold color. Each of the light emitting units 101 and 102 has a plurality of LEDs. The illumination state of the light emitted from each of the first and second light emitting units 101 and 102 is positively related to an adjustable electric current flowing therethrough. Thus, various illumination states of the light emitted by the LED module 10 can be obtained by adjusting the electric current flowing through each of the first and second light emitting units 101 and 102.

The light-adjusting circuit 11 includes a power switch 110, an AC/DC converter 111, a control unit 112 and an adjusting unit 114.

The power switch 110 is electrically connected to the AC power source for receiving the AC power, and is switchable between a closed state, in which the power switch 110 is configured to transmit the AC power, and an open state, in which the powers witch 110 is configured to interrupt transmission of the AC power.

The AC/DC converter 111 is electrically connected to the power switch 110, and is operable to convert the AC power received from the power switch 110 into a direct current (DC) power and to output the DC power when the power switch 110 is in the closed state.

The control unit 112 is electrically connected to the AC/DC converter 111, and includes a counter 113 and a capacitor (C). The capacitor (C) is charged to store electrical energy when the power switch 110 is in the closed state, and can provide the counter 113 with electric power when the power switch 110 is in the open state. Accordingly, the counter 113 is operable to count a number of times that the power switch 110 is switched from the open state to the closed state, and the counted number of times corresponds to a particular one of the illumination states. The control unit 112 is operable to output a current setting value, which is associated with the particular one of the illumination states, according to the counted number of times.

The adjusting unit 114 is electrically connected to the AC/DC converter 111, the control unit 112, the first light emitting unit 101 and the second light emitting unit 102. When the power switch 110 is in the closed state, the adjusting unit 114 is operable to adjust the electric current to the first light emitting unit 101 and the second light emitting unit 102 according to the current setting value received from the control unit 112. Thus, a user can adjust the illumination state of the light emitted by the adjustable lighting device 1 by switching the power switch 110 from the closed state to the open state and then switching back to the closed state within a threshold time, which is related to a discharge time of the capacitor (C).

Nonetheless, the conventional adjustable lighting device 1 has several drawbacks. For example, when the power switch 110 is first switched from the open state to the closed state, the adjustable lighting device 1 emits the light with a default illumination state. When the user desires another illumination state, the user has to switch the power switch 110 multiple times. This results in waste of time and excessive usage of the power switch 110, such that the service life of the power switch 110 may be short. In addition, there is a requirement of the capacitor (C) providing the electric power to the counter 113 to keep track of the counted number of times when the power switch 110 is in the open state. As a result, a manufacturing cost of the conventional adjustable lighting device 1 is increased.

SUMMARY OF THE INVENTION

Therefore, the object of the present invention is to provide a method for setting and adjusting light emitted from an adjustable lighting device capable of overcoming the aforementioned drawbacks.

Accordingly, a method of the present invention is for setting and adjusting brightness and color temperature of light emitted from an adjustable lighting device. The adjustable lighting device includes a timing unit and a non-volatile memory (NVM) module. The NVM module is used for storing a record data which includes a memory flag changeable between a set state and a reset state, and a plurality of light setting values which are associated with respective illumination states of the light emitted from the adjustable lighting device. The method comprises the following steps of:

configuring the adjustable lighting device to allow a user to select one of the illumination states of the light, and configuring the timing unit to start timing an elapsed time in response to selection of one of the illumination states; and configuring the adjustable lighting device to change the memory flag in the record data to the set state and to store the record data with a corresponding one of the light setting values that is associated with the selected one of the illumination states of the light in the NVM module when the elapsed time is longer than a predetermined threshold time period.

Another object of the present invention is to provide an adjustable lighting device capable of storing a current illumination state of light.

Accordingly, an adjustable lighting device of the invention comprises a light emitting module and a light-adjusting circuit.

The light emitting module is operable to selectively emit light with various illumination states, each of which corresponds to a specific brightness and a specific color temperature.

The light-adjusting circuit includes a power switch, an AC/DC converter, a processor, and an adjusting unit.

The power switch is to be electrically connected to an alternating current (AC) power source for receiving an AC power therefrom. The power switch is operable between a closed state, in which the power switch is configured to transmit the AC power, and an open state, in which the power switch is configured to interrupt transmission of the AC power.

The AC/DC converter is electrically connected to the power switch, and is operable to convert the AC power received from the power switch into a direct current (DC) power and to output the DC power when the power switch is in the closed state.

The processor is electrically connected to the AC/DC converter, and includes a non-volatile memory (NVM) module for storing a record data and a plurality of light setting values. Each of the light setting values is associated with a respective one of the illumination states of the light. The record data includes one of the light setting values and a memory flag. Said one of the light setting values is associated with a selected one of the illumination states of the light. The memory flag is changeable between a set state and a reset state. The processor is operable to determine whether the memory flag is in the set state when the power switch is in the closed state, and to further obtain, from the NVM module, said one of the light setting values associated with the selected one of the illumination states of the light when result of the determination made thereby is affirmative.

The adjusting unit is electrically connected to the light emitting module, the AC/DC converter and the processor. The adjusting unit is operable to further receive said one of the light setting values from the processor when the power switch is in the closed state, and to provide the DC power to the light emitting module according to said one of the light setting values so as to adjust the light emitted by the light emitting module to have the specific brightness and the specific color temperature corresponding to the selected one of the illumination states.

Still another object of the present invention is to provide a light-adjusting circuit.

Accordingly, a light-adjusting circuit of the invention is used for controlling light emitted by a light emitting module, and comprises a power switch, an AC/DC converter, a processor and an adjusting unit.

The power switch is to be electrically connected to an alternating current (AC) power source for receiving an AC power therefrom. The power switch is operable between a closed state, in which the power switch is configured to transmit the AC power, and an open state, in which the power switch is configured to interrupt transmission of the AC power.

The AC/DC converter is electrically connected to the power switch, and is operable to convert the AC power received from the power switch into a direct current (DC) power and to output the DC power when the power switch is in the closed state.

The processor is electrically connected to the AC/DC converter, and includes a non-volatile memory (NVM) module for storing a record data and a plurality of light setting values. Each of the light setting values is associated with a respective one of the illumination states of the light. The record data includes one of the light setting values and a memory flag. Said one of the light setting values is associated with a selected one of the illumination states of the light. The memory flag is changeable between a set state and a reset state. The processor is operable to determine whether the memory flag is in the set state when the power switch is in the closed state, and to obtain, from the NVM module, said one of the light setting values associated with the selected one of the illumination states of the light when result of the determination made thereby is affirmative.

The adjusting unit is electrically connected to the AC/DC converter and the processor, and is operable to receive said one of the light setting values from the processor when the power switch is in the closed state. The adjusting unit is to be electrically connected to the light emitting module for providing the DC power to the light emitting module according to said one of the light setting values so as to adjust the light emitted by the light emitting module to have the specific brightness and the specific color temperature corresponding to the selected one of the illumination states.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
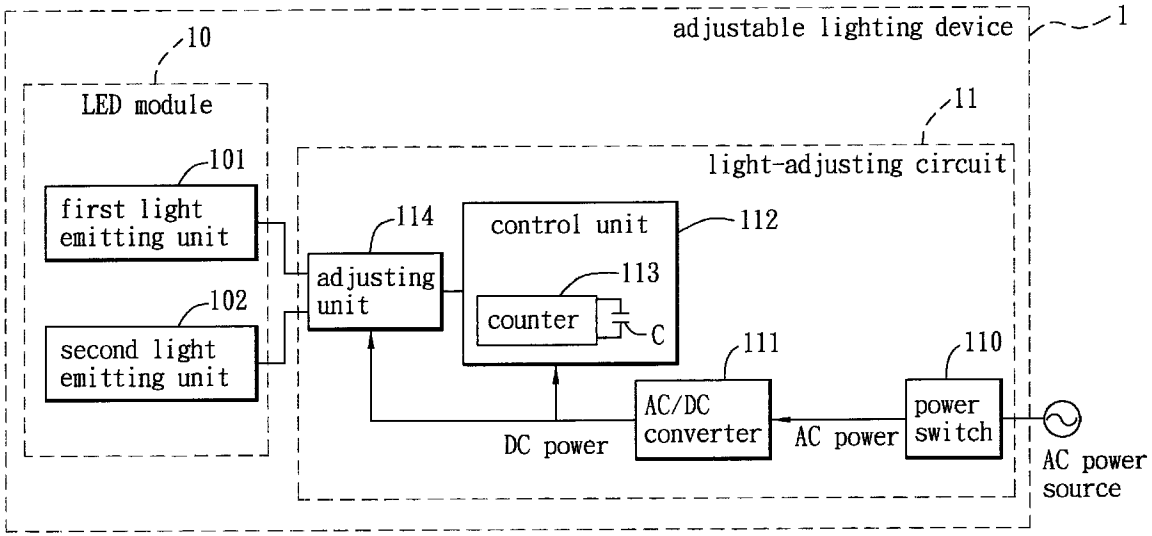
FIG. 1 PRIOR ART
FIG. 1 is a schematic block diagram of a conventional adjustable lighting device.
Figure 2:
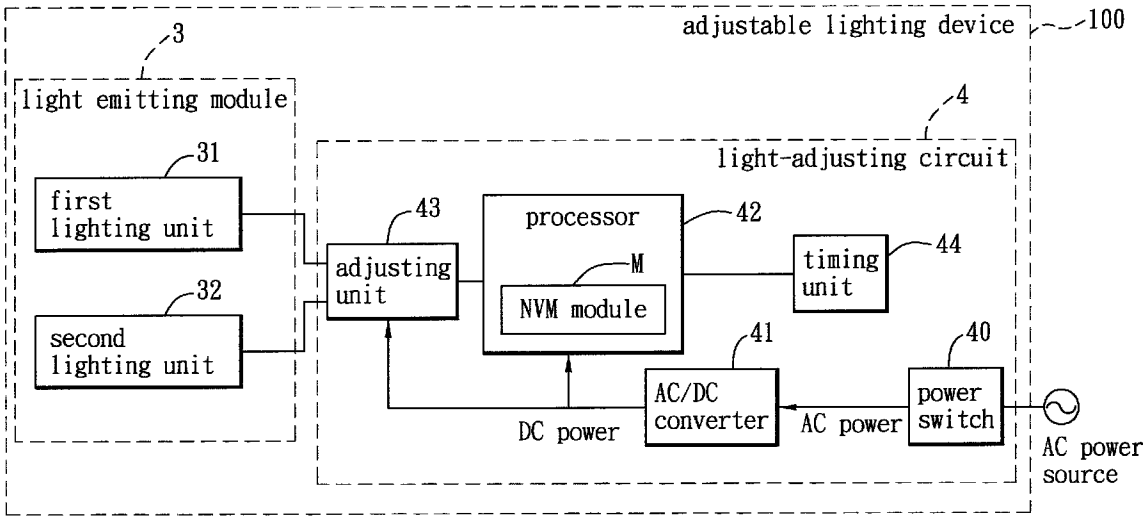
FIG. 2 is a schematic block diagram of a preferred embodiment of an adjustable lighting device of this invention.

As shown in FIG. 2, the preferred embodiment of an adjustable lighting device 100 according to the present invention includes a light emitting module 3 and a light-adjusting circuit 4.

The light emitting module 3 is operable to selectively emit light with various illumination states, each of which corresponds to a specific brightness and a specific color temperature. In this embodiment, the light emitting module 3 includes a first lighting unit 31 and a second lighting unit 32. The first lighting unit 31 is operable to emit light with a warm color, and the second lighting unit 32 is operable to emit light with a cold color. For example, each of the first and second lighting units 31 and 32 has a plurality of light emitting diodes (not shown in the Figures). The illumination state of the light emitted from each of the first and second light emitting units 31 and 32 is positively related to an adjustable electric current flowing there through. Thus, the light emitting module 3 is operable to emit the light with various illumination states by adjusting the electric current flowing through each of the first and second light emitting units 31 and 32.

The light-adjusting circuit 4 includes a power switch 40, an AC/DC converter 41, a processor 42, an adjusting unit 43, and a timing unit 44 electrically connected to the processor 42.

The power switch 40 is to be electrically connected to an alternating current (AC) power source for receiving an AC power therefrom. The power switch 40 is switchable between a closed state, in which the power switch 40 is configured to transmit the AC power, and an open state, in which the power switch 40 is configured to interrupt transmission of the AC power.

The AC/DC converter 41 is electrically connected to the power switch 40, and is operable to convert the AC power received from the power switch 40 into a direct current (DC) power and to output the DC power when the power switch 40 is in the closed state.

The processor 42, such as a microprocessor, includes a non-volatile memory (NVM) module (M) capable of retaining data stored therein without electric power supply. In this embodiment, the data stored in the NVM module (M) includes a record data and a plurality of light setting values, each of which is associated with a respective one of the illumination states of the light. The record data may include one of the light setting values that is associated with a selected one of the illumination states of the light, and a memory flag that is changeable between a set state and a reset state. The memory flag is set to a high level logic (i.e., 1) in the set state, indicating that the record data currently includes a corresponding one of the light setting values that is associated with a desired one of the illumination states of the light. Alternatively, a low level logic (i.e., 0) is assigned to the memory flag when the memory flag is in the reset state, indicating that the record data does not include a corresponding one of the light setting values associated with the desired one of the illumination states.

The adjusting unit 43 is electrically connected to the light emitting module 3, the AC/DC converter 41 and the processor 42. When the power switch 40 is in the closed state (i.e., the DC power is supplied to the adjusting unit 43), the adjusting unit 43 is operable to receive the light setting value in the record data from the processor 42, and to adjust the light emitted from the light emitting module 3 to have the specific brightness and the specific color temperature corresponding to the selected one of the illumination states according to the light set ting value thus received. Specifically, each of the light setting values includes a particular electric current value. The adjusting unit 43 is electrically connected to the first and second lighting units 31 and 32 so as to adjust the brightness and the color temperature of the light emitted therefrom by varying the electric current passing therethrough.

Figure 3:
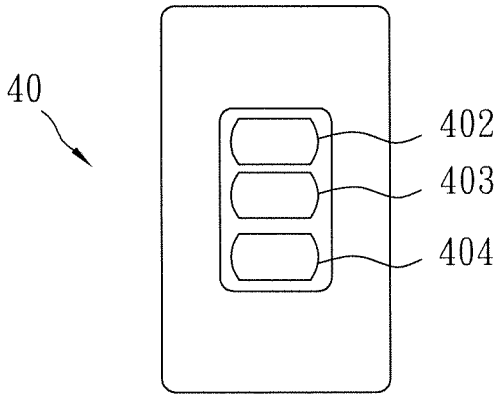
FIG. 3 is a schematic diagram illustrating an example of a power switch of the adjustable lighting device of the preferred embodiment.

In an example, the power switch 40 has a plurality of buttons 402 to 404 (for illustrative proposes, only three buttons are present in this example), as shown in FIG. 3. Each of the buttons 402 to 404 is associated with one of the illumination states, such that a user can directly select one of the illumination states by pushing a corresponding one of the buttons 402 to 404.

Figure 4:
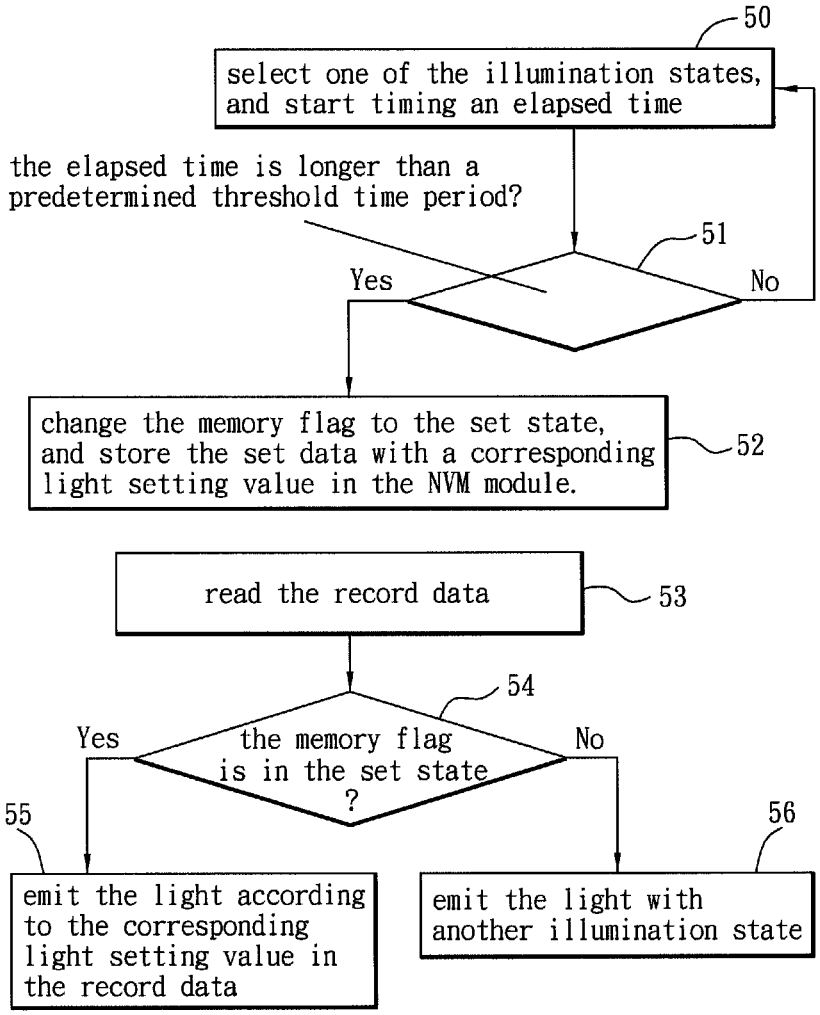
FIG. 4 is a flow chart illustrating a method for setting and adjusting brightness and color temperature of light emitted from the adjustable lighting device of FIG. 2, according to an example of the invention.

FIG. 4 shows a method for setting and adjusting the light emitted from the adjustable lighting device 100.

In step 50, the adjustable lighting device 100 is operable to allow the user to select one of the illumination states of the light (for example, using the power switch 40), and the timing unit 44 is operable to start timing an elapsed time in response to selection of one of the illumination states. Afterward, the processor 42 is operable, in step 51, to determine whether the elapsed time is longer than a predetermined threshold time period. If the determination is affirmative, the flow goes to step 52. Otherwise, the flow goes back to step 50.

In step 52, the processor 42 is operable to change the memory flag in the record data to the set state, and to store the record data with a corresponding one of the light setting values that is associated with the selected one of the illumination states of the light in the NVM module (M).

In step 53, when the power switch 40 is switched from the open state to the closed state next time, the processor 42 is operable to read the record data stored in the NVM module. Afterward, the processor 42 is operable, in step 54, to determine whether the memory flag is in the set state. If the determination is affirmative, the flow goes to step 55. Otherwise, the flow goes to step 56.

In step 55, the processor 42 is operable to output the light setting value in the record data, which was read in step 53, to the adjusting unit 43, and the adjusting unit 43 is operable, according to the light setting value thus received, to control the light emitting module 3 to emit the light with the selected one of the illumination states. In step 56, the adjustable lighting device 100 is operable to emit the light with another one of the illumination states, for example, that is currently selected by the user.

Figure 5:
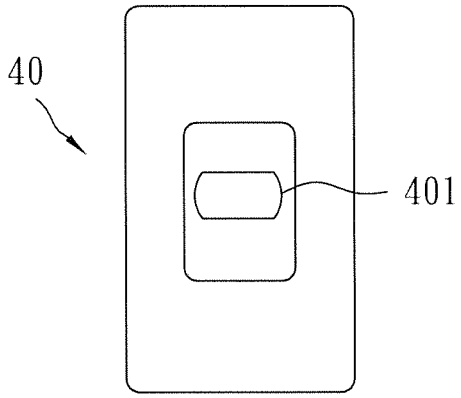
FIG. 5 is a schematic diagram illustrating another example of the power switch of the adjustable lighting device of the preferred embodiment.
Figure 6:
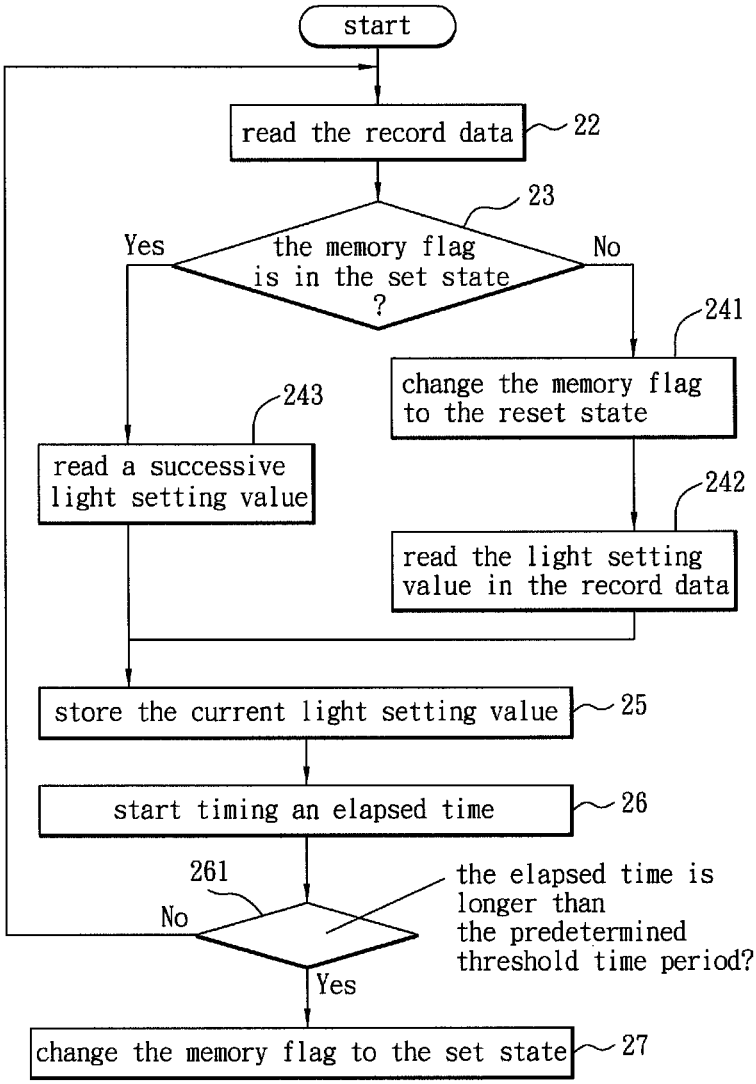
FIG. 6 is a flowchart illustrating another method for setting and adjusting brightness and color temperature of light emitted from the adjustable lighting device of FIG. 2, according to another example of the invention.

In another example, the power switch 40 has a single button 401 (see FIG. 5). In the present example, the light setting values are stored in the NVM module (M) with a particular sequence, and the adjustable lighting device 100 is operable to perform another method, as shown in FIG. 6, for setting and adjusting the light emitted therefrom.

In step 22, the processor 42 is operable to read the record data stored in the NVM module (M).

In step 23, the processor 42 is operable to determine whether the memory flag is in the set state. If the determination is affirmative, the flow goes to step 241. Otherwise, the flow goes to step 243.

In step 241, the processor 42 is operable to change the memory flag to the reset state. Afterward, the processor 42 is operable, instep 242, to read the light setting value in the record data and to transmit this light setting value to the adjusting unit 43.

Alternatively, in step 243, the processor 42 is operable to read from the NVM module (M) a successive one of the light setting values, which is next to the current light setting value with respect to the particular sequence, and to transmit the successive one of the light setting values to the adjusting unit 43. Thus, the adjusting unit 43 is operable to adjust the brightness and the color temperature of the light emitted from the light emitting module 3 according to the successive one ofh te light setting values.

Subsequently, in step 25, the processor 42 is operable to update the record data with the memory flag of the reset state and the current one of the light setting values (i.e., the successive light setting value read in step 243). In step 26, the processor 42 is operable to configure the timing unit 44 to start timing an elapsed time.

Then, in step 261, the processor 42 is operable to determine whether the elapsed time is longer than the predetermined threshold time period. The flow goes to step 27 when the elapsed time is longer than the predetermined threshold time period, that is to say, the user does not intend to change the current illumination state and does not turn the power switch 40 to the open state within the predetermined threshold time period. On the other hand, the flow goes back to step 22 when the user intends to change the current illumination state and does not switch the power switch 40 to the open state before the predetermined threshold time period was elapsed. In this case, the adjustable lighting device 100 awaits the power switch 40 to be switched to the closed state again, and the memory flag of the record data stored in the NVM module (M) is set to the reset state.

In step 27, the processor 42 is operable to change the memory flag in the record data to the set state, and to store the record data in the NVM module (M) with a corresponding one of the light setting values that is associated with the current illumination state of the light.

In practice, it is assumed that, in this embodiment, the adjustable lighting device 100 is configured to have four illumination states associated respectivley with four light setting values (0, 1, 2, and 3) that are stored in the NVM module (M) in the particular sequence. For example, the four illumination states include an initial state, a first state, a second state and a third state. The default settings of the light setting value and the memory flag in the record data can be denoted by (0, 0). When the power switch 40 is switched to the closed state for the first time, the processor 42 is operable to read the record data stored in the NVM module (M) in step 22, and to determine that the memory flag is in the reset state in step 23. As a result, the flow goes to step 243, in which the processor 42 reads the successive one of the light setting values (i.e., 1) and makes the light setting value and the memory flag as (1, 0), and then goes to step 25, in which the processor 42 stores the record data with the updated light setting value and the memory flag (1, 0) to the NVM module (M). Afterward, in step 26, the timing unit 44 is operable to start timing the elapsed time. If the user does not prefer the first illumination state, other illumination states can be obtained by switching the power switch 40 before the elapsed time becomes longer than the predetermined threshold time period. Upon every switching of the power switch 40 from the open state to the closed state, a successive light setting value is read by the processor 42 and the adjustable lighting device 100 can emit the light with the illumination state associated with the light setting value accordingly. For example, when the user intends to use the third illumination state, the user can switch the power switch 40 repeatedly until the third illumination state is obtained. At this time, the light setting value and the memory flag are changed to (3, 0). Then, when the user switches the power switch 90 from the closed state to the open state after the predetermined threshold time period has elapsed, the processor 42 is operable to change the memory flag to the set state (1), and to store the record data in the NVM module (M) with the memory flag in the set state and the current light setting value (i.e., (3, 1)) that is associated with the third illumination state.

Afterward, next time the adjustable lighting device 100 is to be used, the processor 42 is operable, in step 22, to read the values (3, 1) from the NVM module (M), so that the adjustable lighting device 100 is able to emit the light with the third illumination state according to the corresponding one of the light setting values (3) in the record data.

To sum up, the presence of the memory flag in the set state allows the adjustable lighting device 100 to read the previously used illumination state, thereby reducing the need to repeatedly switch the power switch 40 in every use to find the preferred illumination state. The proposed configuration aims to make the adjustable lighting device 100 more convenient to use, and to allow the power switch 90 to have a relatively longer service life.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method for setting and adjusting brightness and color temperature of light emitted from an adjustable lighting device, the adjustable lighting device including a non-volatile memory (NVM) module for storing a record data which includes a memory flag changeable between a set state and a reset state, and a plurality of light setting values which are associated with respective illumination states of the light, said method comprising the following steps of:

configuring the adjustable lighting device to start timing an elapsed time when one of the illumination states of the light is selected; and configuring the adjustable lighting device to change the memory flag in the record data to the set state and to store the record data with a corresponding one of the light setting values that is associated with the selected one of the illumination states when the elapsed time is longer than a predetermined threshold time period.

2. The method as claimed in claim 1, further comprising the following steps:

configuring the adjustable lighting device to read the record data stored in the NVM module;

configuring the adjustable lighting device to determine whether the memory flag of the record data is in the set state; and when it is determined that the memory flag is in the set state, configuring the adjustable lighting device to adjust brightness and color temperature of the light with the selected one of the illumination states according to the corresponding one of the light setting values of the record data.

3. An adjustable lighting device comprising:

a light emitting module operable to selectively emit light with various illumination states, each of which corresponds to a specific brightness and a specific color temperature; and a light-adjusting circuit including a power switch to be electrically connected to an alternating current (AC) power source for receiving an AC power therefrom, said power switch being operable between a closed state, in which said power switch is configured to transmit the AC power, and an open state, in which said power switch is configured to interrupt transmission of the AC power, an AC/DC converter electrically connected to said power switch, and operable to convert the AC power received from said power switch into a direct current (DC) power and to output the DC power when said power switch is in the closed state, a processor electrically connected to said AC/DC converter and including a non-volatile memory (NVM) module for storing a record data and a plurality of light setting values each of which is associated with a respective one of the illumination states of the light, the record data including one of the light setting values that is associated with a selected one of the illumination states of the light and a memory flag that is changeable between a set state and a reset state, said processor being operable to determine whether said memory flag is in the set state when said power switch is in the closed state, and to obtain from said NVM module said one of the light setting values associated with said selected one of the illumination states of the light when result of the determination made thereby is affirmative, and an adjusting unit electrically connected to said light emitting module, said AC/DC converter and said processor, and operable to receive said one of the light setting values from said processor when said power switch is in the closed state, and to provide the DC power to said light emitting module according to said one of the light setting values so as to adjust the light emitted by said light emitting module to have the specific brightness and the specific color temperature corresponding to said selected one of the illumination states.

4. The adjustable lighting device as claimed in claim 3, wherein said light emitting module includes a first lighting unit and a second lighting unit that are operable to emit lights with respective colors.

5. The adjustable lighting device as claimed in claim 4, wherein one of said first and second lighting units is operable to emit light with a warm color, and the other of said first and second lighting units is operable to emit light with a cold color.

6. The adjustable lighting device as claimed in claim 3, further comprising a timing unit coupled to said processor, wherein, when said power switch is changed from the open state to the closed state:

said processor is operable to store the record data with the memory flag in the reset state and a current one of the light setting values into said NVM module;

said timing unit is operable to start timing an elapsed time;

said processor is further operable to change the memory flag to the set state when the elapsed time period is longer than a predetermined threshold time period.

7. A light-adjusting circuit for controlling light emitted by a light emitting module, said light-adjusting circuit comprising:

a power switch to be electrically connected to an alternating current (AC) power source for receiving an AC power therefrom, said power switch being operable between a closed state, in which said power switch is configured to transmit the AC power, and an open state, in which said power switch is configured to stop transmission of the AC power;

an AC/DC converter electrically connected to said power switch, and operable to convert the AC power received from said power switch into a direct current (DC) power and to output the DC power when said power switch is in the closed state;

a processor electrically connected to said AC/DC converter and including a non-volatile memory (NVM) module for storing a record data and a plurality of light setting values each of which is associated with a respective one of the illumination states of the light, the record data including one of the light setting values that is associated with a selected one of the illumination states of the light and a memory flag that is changeable between a set state and a reset state, said processor being operable to determine whether said memory flag is in the set state when said power switch is in the closed state, and to obtain from said NVM module said one of the light setting values associated with said selected one of the illumination states of the light when result of the determination made thereby is affirmative, and an adjusting unit electrically connected to said AC/DC converter and said processor and operable to receive said one of the light setting values from said processor when said power switch is in the closed state, said adjusting unit to be electrically connected to the light emitting module for providing the DC power to the light emitting module according to said one of the light setting values so as to adjust the light emitted by the light emitting module to have the specific brightness and the specific color temperature corresponding to said selected one of the illumination states.

8. The light-adjusting circuit as claimed in claim 7, further comprising a timing unit coupled to said processor, wherein, when said power switch is changed from the open state to the closed state:

said processor is operable to store the record data with the memory flag in the reset state and a current one of the light setting values into said NVM module;

said timing unit is operable to start timing an elapsed time; and said processor is further operable to change the memory flag to the set state when the elapsed time period is longer than a predetermined threshold time period.

* * * * *